US011383357B2

(12) United States Patent
Wu

(10) Patent No.: US 11,383,357 B2
(45) Date of Patent: Jul. 12, 2022

(54) UNIVERSAL PLIERS

(71) Applicant: Ming-Chieh Wu, Taichung (TW)

(72) Inventor: Ming-Chieh Wu, Taichung (TW)

( * ) Notice: Subject to any disclaimer, the term of this patent is extended or adjusted under 35 U.S.C. 154(b) by 237 days.

(21) Appl. No.: 16/803,666

(22) Filed: Feb. 27, 2020

(65) Prior Publication Data

US 2020/0331123 A1 Oct. 22, 2020

(30) Foreign Application Priority Data

Apr. 22, 2019 (TW) ..... 108114016

(51) Int. Cl.

| | |
|---|---|
| ***B25B 7/12*** | (2006.01) |
| ***B25B 7/06*** | (2006.01) |
| ***B25B 7/18*** | (2006.01) |
| ***B25B 7/16*** | (2006.01) |
| ***B25B 7/04*** | (2006.01) |

(52) U.S. Cl.

CPC ..... *B25B 7/123* (2013.01); *B25B 7/04* (2013.01); *B25B 7/06* (2013.01); *B25B 7/16* (2013.01); *B25B 7/18* (2013.01)

(58) Field of Classification Search

CPC .. B25B 7/123; B25B 7/00; B25B 7/02; B25B 7/04; B25B 7/06; B25B 7/10; B25B 7/12; B25B 7/14; B25B 7/18; B25B 5/00; B25B 5/003; B25B 5/04; B25B 5/06; B25B 9/00; B21D 39/025; B25F 1/003; B25F 1/04

See application file for complete search history.

(56) References Cited

U.S. PATENT DOCUMENTS

| | | | | |
|---|---|---|---|---|
| 2,532,659 | A * | 12/1950 | Burns | B25B 7/123 81/371 |
| 2,669,145 | A * | 2/1954 | Mead | B25B 7/123 81/370 |
| 3,996,822 | A * | 12/1976 | Battista | B25B 7/00 81/367 |
| 5,233,893 | A * | 8/1993 | Schmidt | B25B 7/123 81/368 |
| 6,708,587 | B1 * | 3/2004 | Noniewicz | B25B 5/06 81/313 |
| 2016/0361799 | A1 * | 12/2016 | Levinson | B25B 13/5058 |

FOREIGN PATENT DOCUMENTS

WO WO 2016/201100 A1 12/2016

OTHER PUBLICATIONS

Search Report appended to an Office Action, which was issued to Chinese counterpart application No. 202010122797.8 by the CNIPA dated Jun. 22, 2021, with an English translation thereof.

* cited by examiner

*Primary Examiner* — Robert J Scruggs

(74) *Attorney, Agent, or Firm* — Lewis Roca Rothgerber Christie LLP

(57) ABSTRACT

A pair of universal pliers includes a fixed structure, a movable structure movably connected to the fixed structure and including front and rear movable handle plates, and a quick release mechanism including a trigger and a resilient locking subunit. The resilient locking subunit includes a movable pin inserted through and slidable along a first guide slot of the front movable handle plate and a second guide slot of the rear movable handle plate. The resilient locking subunit is switchable between a locked state where the rear movable handle plate cannot pivot relative to the front movable handle plate and a non-locked state where the rear movable handle plate can pivot relative to the front movable handle plate.

7 Claims, 10 Drawing Sheets

UNIVERSAL PLIERS

CROSS-REFERENCE TO RELATED APPLICATION

This application claims priority of Taiwanese Patent Application No. 108114016, filed on Apr. 22, 2019.

FIELD

The disclosure relates to a hand held clamp tool, more particularly, to a pair of universal pliers.

BACKGROUND

Referring to FIG. 1, a pair of conventional universal pliers 12 with a quick release mechanism includes a first jaw 121, an upper handle 122 connected to the first jaw 121, a second jaw 123 disposed opposite to the first jaw 121, a front handle 124 pivotally coupled to the second jaw 123, a rear handle 125 pivotally coupled to the front handle 124, a linkage mechanism 126 for actuating the front handle 124 to rotate and in turn drive the second jaw 123 to a position for releasing or clamping an object 13, and a locking mechanism 127 for retaining a rigid connection between the front handle 124 and the rear handle 125. The locked mechanism 127 includes an arcuate slot 1271 formed in the front handle 124, and a release button 1272 disposed with respect to the front handle 124 for operatively associating with a movable pin 1273 engaged in the arcuate slot 1271. The release button 1272 also includes an elongate slot 1274 for mounting the rear handle 125. While the object 13 is clamped by the universal pliers 12, the movable pin 1273 is restricted from moving by the arcuate slot 1271 so that the rear handle 125 is prevented from rotating relative to the front handle 124, thereby maintaining the universal pliers 12 in a position for firmly clamping the object 13. As shown in FIG. 2, upon pressing the release button 1272, the moveable pin 1273 is driven along the arcuate slot 1271 to a releasing position where the rear handle 125 is allowed to rotate relative to the front handle 124 and in turn drives the second jaw 123 to rotate counter-clockwise (as indicated by the arrow shown in dotted lines) to release the gripped object 13. This pair of conventional pliers 12 thus allow single-handed manipulation.

SUMMARY

The object of the disclosure is to provide a pair of universal pliers of a newly devised structure that is more convenient to use.

According to the disclosure, the universal pliers comprise a fixed structure, a movable structure, and a quick release mechanism.

The fixed structure extends in a front-rear direction, and includes a fixed jaw plate and a fixed handle plate that extends rearward from the fixed jaw plate. The fixed jaw plate has a fixed clamping portion. The movable structure is movably connected to the fixed structure, and includes a movable jaw plate, a front movable handle plate, and a rear movable handle plate.

The movable jaw plate has a movable clamping portion opposite to the fixed clamping portion and forming a clamping hole that is in conjunction with the fixed clamping portion. The front movable handle plate is pivotally coupled to and extends rearward from the movable jaw plate. The front movable handle plate has a first guide slot at a rear end thereof. The first guide slot defines a locked segment and a releasing segment at opposite ends thereof, and an intermediate segment between the locked segment and the releasing segment. The rear movable handle plate has a pivoting end pivotally coupled to the front movable handle plate, a grip end opposite to and disposed at a rear side of the pivoting end, and a second guide slot located between the pivoting end and the grip end. The movable structure is movable relative to the fixed structure between a retaining position where the movable clamping portion is adjacent to the fixed clamping portion, and a releasing position where the movable clamping portion is spaced far from the fixed clamping portion.

The quick release mechanism includes a trigger and a resilient locking subunit. The trigger is pivotally coupled to and accessibly protrudes from the front movable handle plate. The resilient locking subunit is operatively connected to the trigger and the movable structure, and includes a movable pin, a pulling member, and a resilient member. The movable pin is inserted through and is slidable along the first guide slot and the second guide slot. The pulling member is connected between the movable pin and the trigger, such that the pivot action of the trigger drives the resilient locking subunit to switch between a locked state where the movable pin is located at the locked segment of the first guide slot and where the rear movable handle plate is not permitted to pivot relative to the front movable handle plate, and a non-locked state where the movable pin is located at the intermediate segment of the first guide slot and where the rear movable handle plate is permitted to pivot relative to the front movable handle. The resilient member is connected between the movable pin and the rear movable handle plate to resiliently bias the resilient locking subunit towards the locked state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
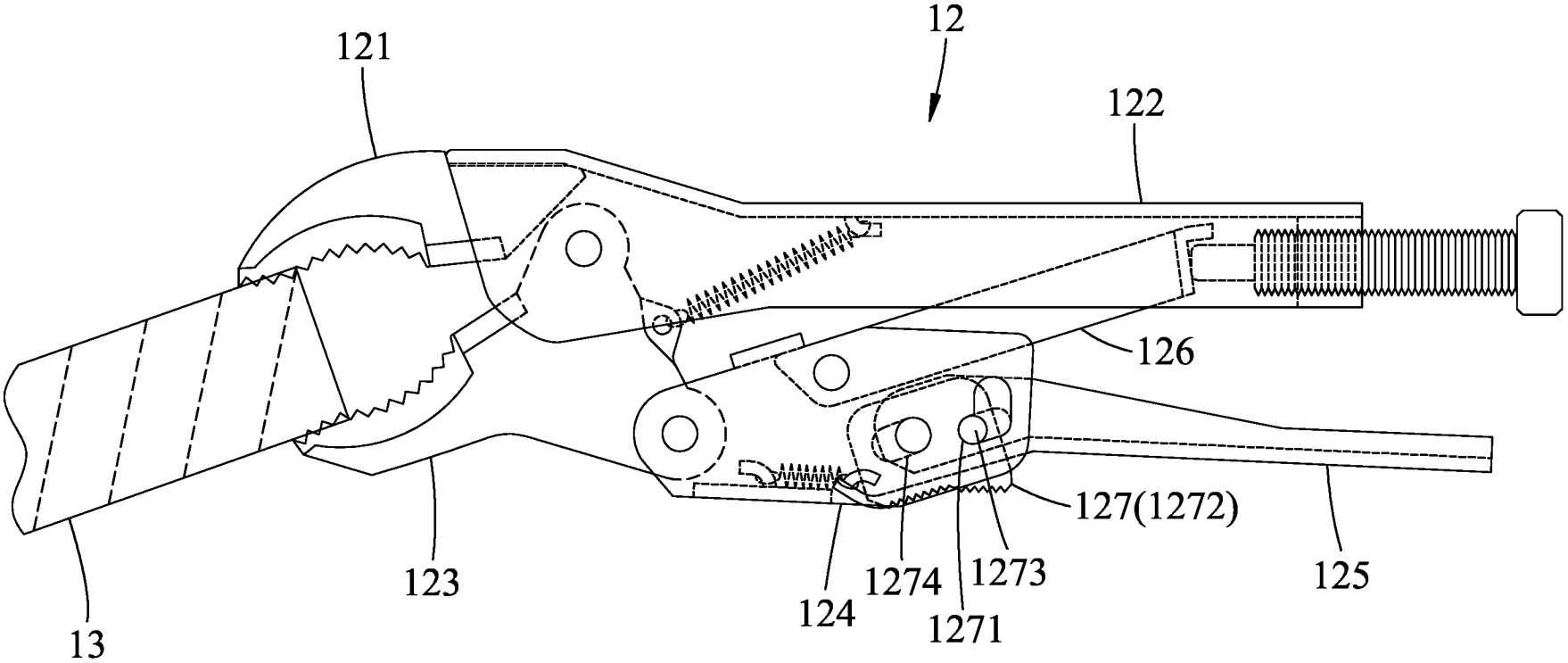
FIG.1 PRIOR ART
FIG. 1 is a side elevational view showing a pair of conventional universal pliers with a quick release mechanism in a locked state.
Figure 2:
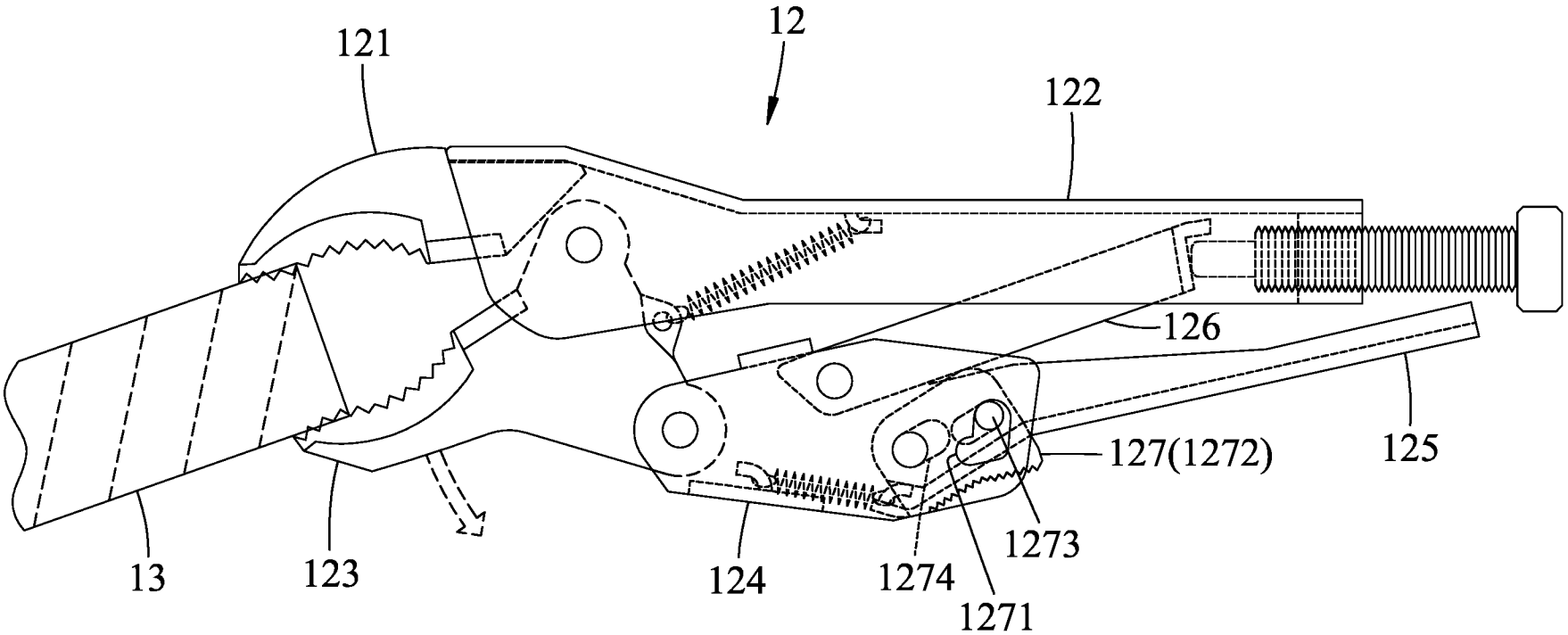
FIG.2 PRIOR ART
FIG. 2 is a view similar to FIG. 1, illustrating the conventional universal pliers with a quick release mechanism in a non-locked state.

Before the present invention is described in greater detail, it should be noted that where considered appropriate, reference numerals or terminal portions of reference numerals have been repeated among the figures to indicate corresponding or analogous elements, which may optionally have similar characteristics.

Figure 3:
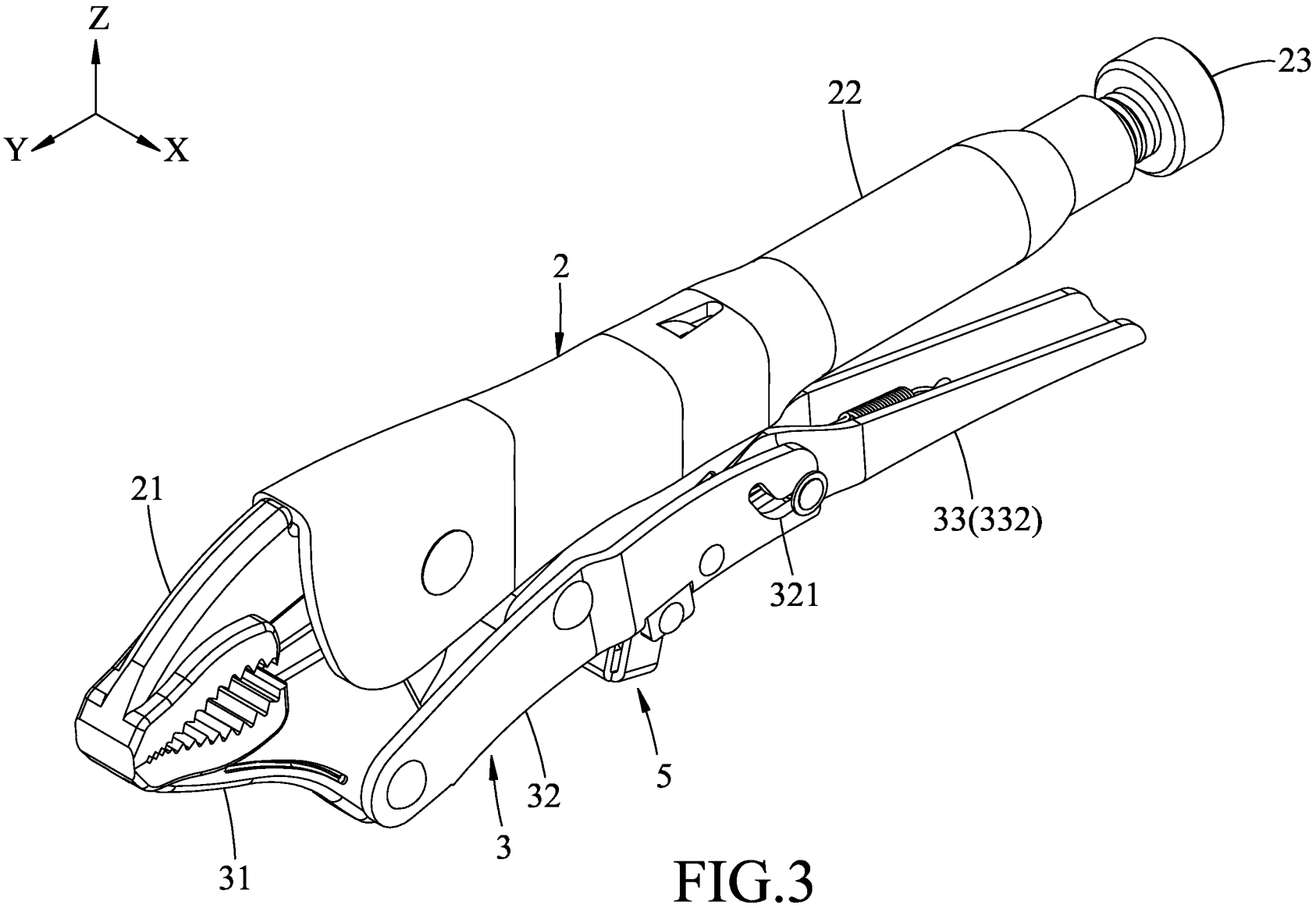
FIG. 3 is a perspective view of an embodiment of a pair of universal pliers according to the disclosure.
Figure 4:
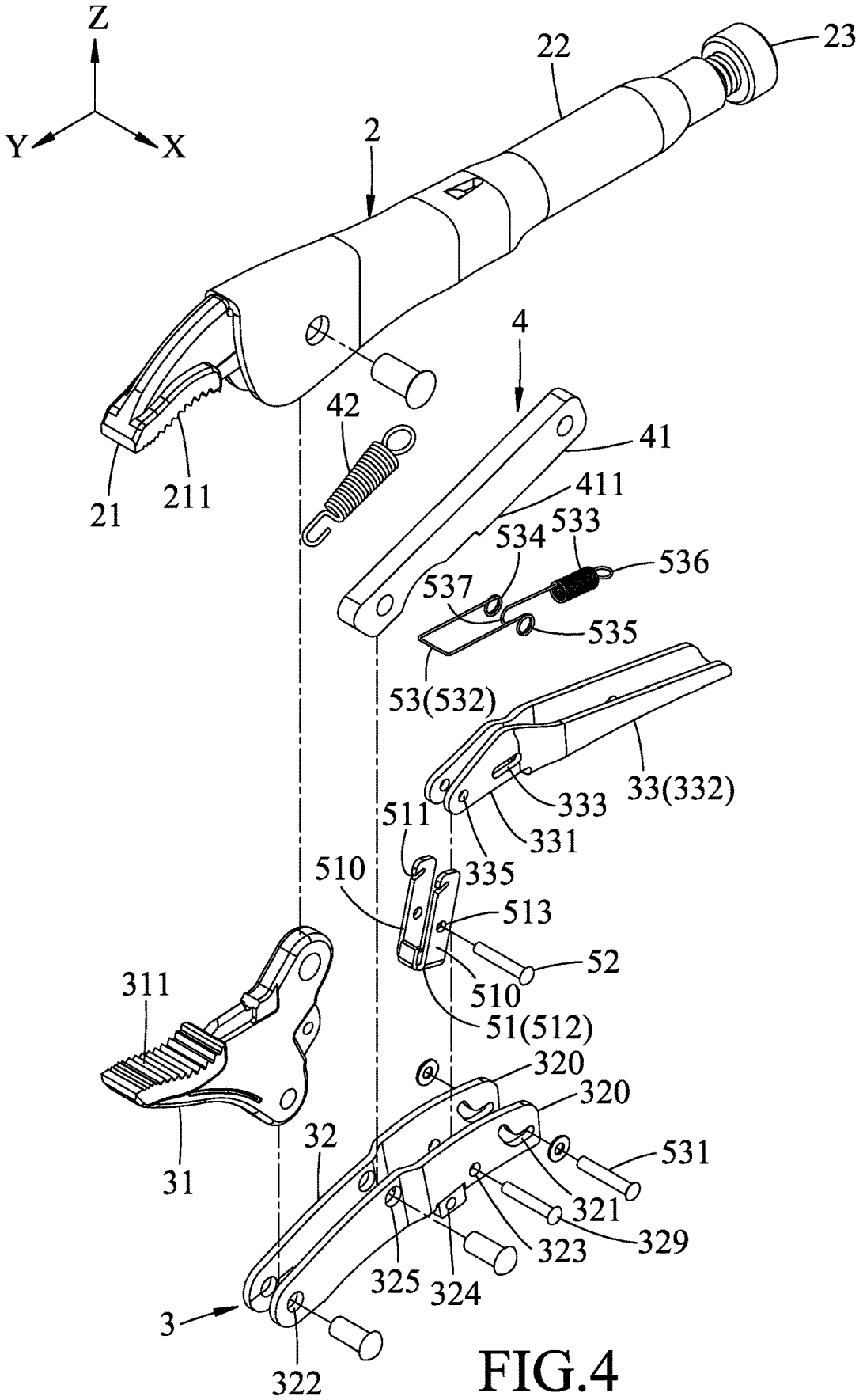
FIG. 4 is an exploded perspective view of the embodiment.
Figure 5:
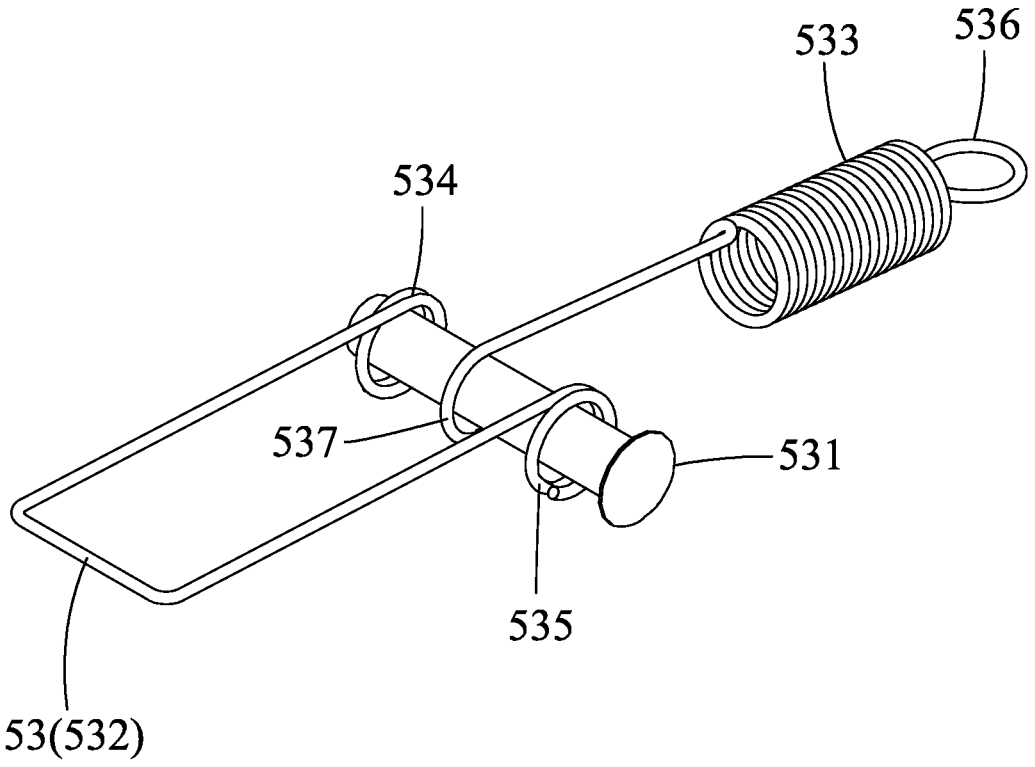
FIG. 5 is a perspective view of a resilient locking subunit of a quick release mechanism of the embodiment.
Figure 6:
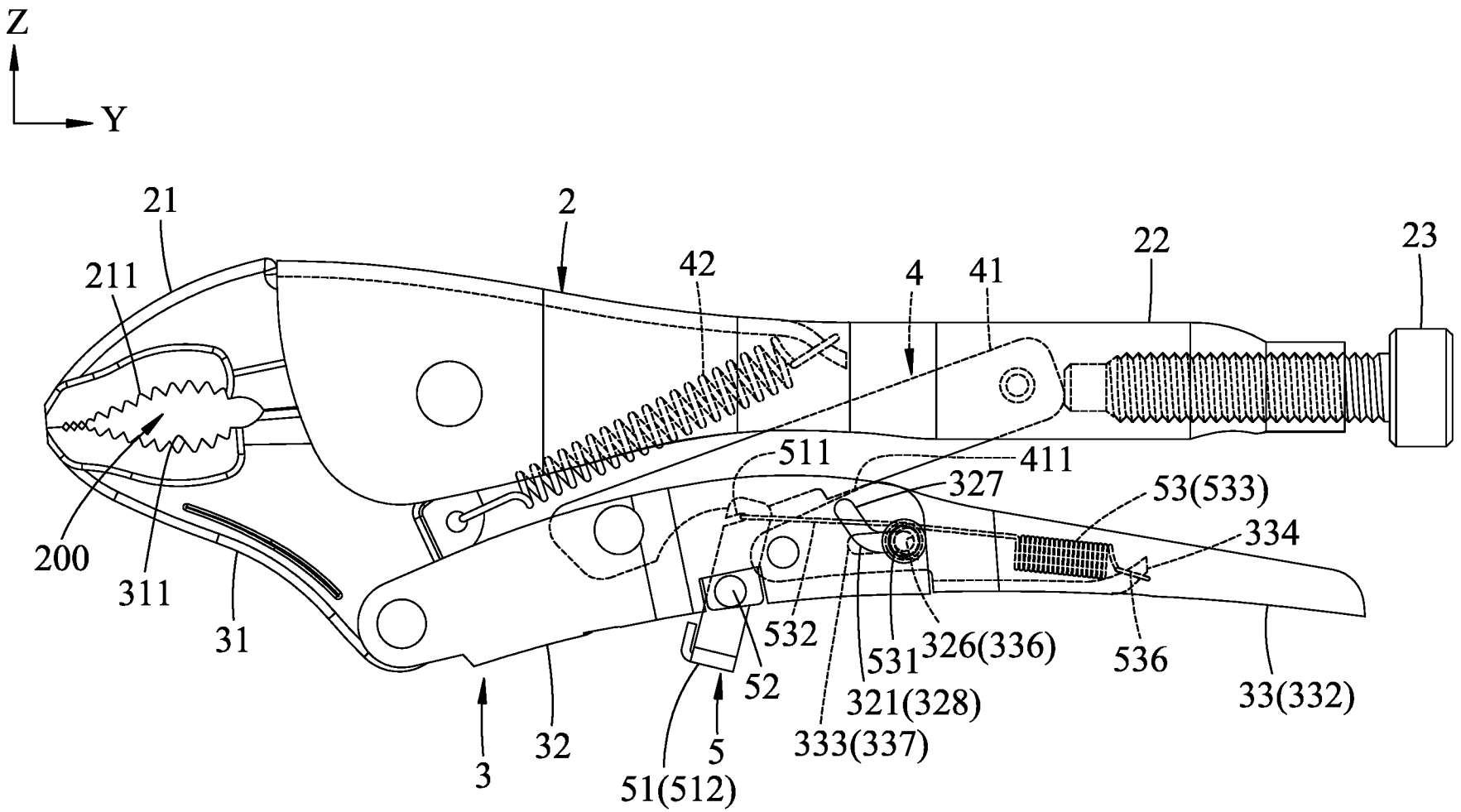
FIG. 6 is a right side schematic view of the embodiment, with a movable structure shown in a retaining position and the resilient locking subunit in a locked state.
Figure 7:
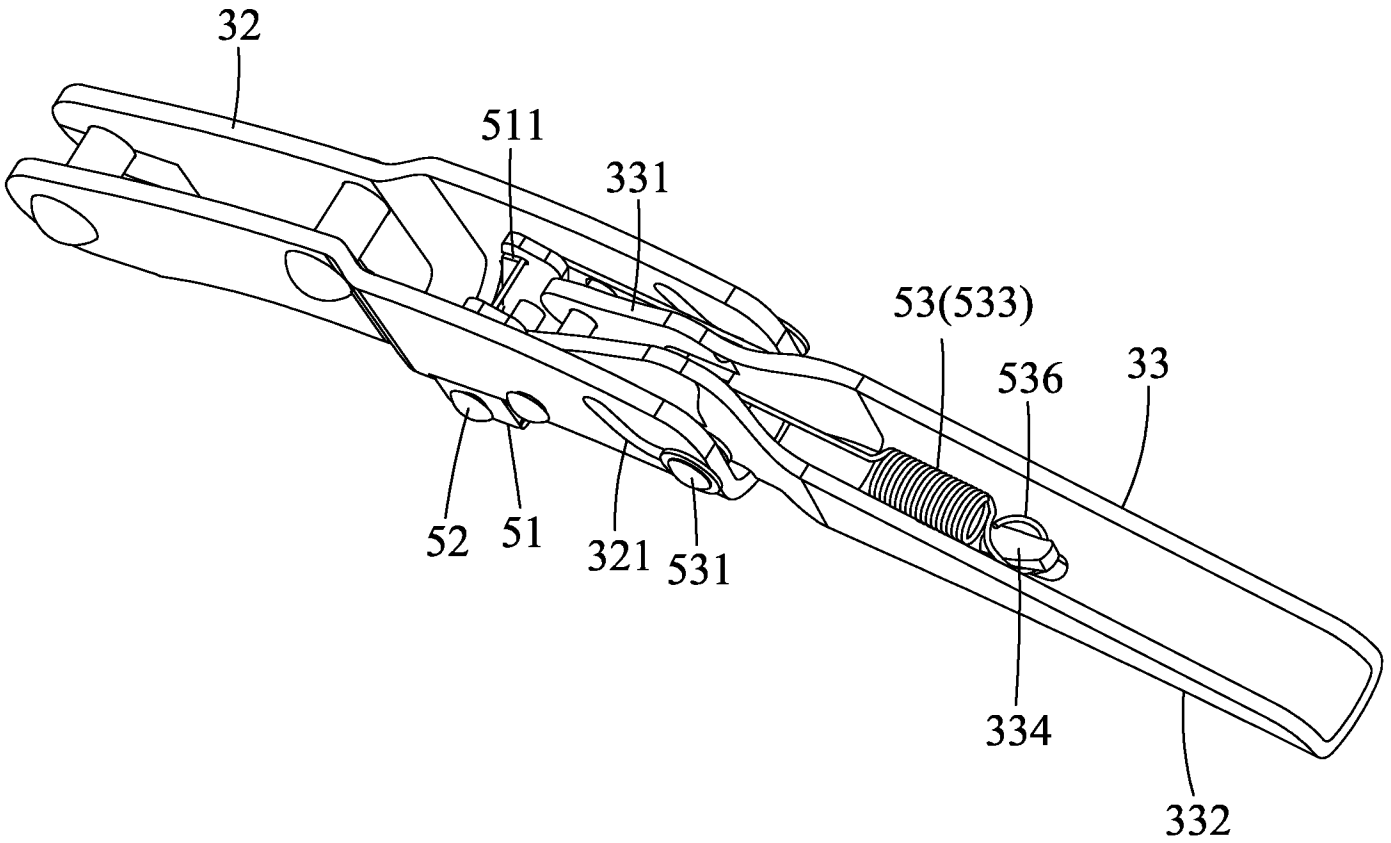
FIG. 7 is a perspective view of the quick release mechanism mounted to the movable structure.

As shown in FIGS. 3, 4 and 6, the embodiment of a pair of universal pliers according to the present disclosure includes a fixed structure 2, a movable structure 3, a linkage mechanism 4 and a quick release mechanism 5.

The fixed structure 2 shown in the illustrations extends in a front-rear direction (Y) and includes a fixed jaw plate 21 with a fixed clamping portion 211, a fixed handle plate 22 extending rearward from the fixed jaw plate 21, and an adjusting screw 23 disposed at a rear end of the fixed handle plate 22. In this embodiment, the adjusting screw 23 is a bolt rotatably screwed onto the fixed handle plate 22.

The movable structure 3 is movably connected to the fixed structure 2 and includes a movable jaw plate 31, a front movable handle plate 32 pivotally coupled to and extending rearward from the movable jaw plate 31, and a rear movable handle plate 33 pivotally coupled to and extending rearward from the front movable handle plate 32. The movable jaw plate 31 has a movable clamping portion 311 opposed to the fixed clamping portion 211 and forms a clamping hole 200 in conjunction with the fixed clamping portion 211 in closing. The movable jaw plate 32 has a first guide slot 321 at a rear end thereof, a jaw pivot hole 322 at a front end thereof for extension of a securing pin to pivotally couple the movable jaw plate 31 and the front movable handle plate 32, a front handle pivot hole 323 located in front of the first guide slot 321, a connecting hole 324 located in front of the front handle pivot hole 323, and a rod pivot hole 325 located between the jaw pivot hole 322 and the connecting hole 324. It is to be particularly noted that, the front movable handle plate 32 is formed by a piece of sheet metal bent to form a channel-shaped cross-section with a base and two parallel side walls 320 spaced apart in a left-right direction (X). It is appreciated that the front movable handle plate 32 may also be formed by other processing methods such as molding, cutting, and the like. It should also be noted that each of all the above-mentioned construction holes or slots actually has two opposite left and right ends being formed respectively in the two side walls 320 in this embodiment.

The first guide slot 321 is a substantially arcuate slot defining an end configured to be a locked segment 326, an opposite end configured to be a releasing segment 327, and an angled portion intermediate between the locked segment 326 and the releasing segment 327 configured to be an intermediate segment 328. The releasing segment 327 is in front of the locked segment 326 in the front-rear direction (Y) and higher than the locked segment 326 in a top-bottom direction (Z).

The rear movable handle plate 33 has a pivoting end 331 pivotally coupled to the front movable handle plate 32 and received between the two side walls 320 of the channel-shaped structure of the front movable handle plate 32, an opposite grip end 332 disposed at a rear side of the pivoting end 331, a second guide slot 333 located between the pivoting end 331 and the grip end 332 and registered with the first guide slot 321, and a bar hook 334 integrally formed at the grip end 332. The pivoting end 331 is formed with a rear handle pivot hole 335 registered with the front handle pivot hole 323 of the front movable handle plate 32, so that the rear movable handle plate 33 is capable of pivot relative to the front movable handle plate 32 about the pivot pin 329 extending through the front handle pivot hole 323 and the rear handle pivot hole 335. The second guide slot 333 has a first end segment 336 and an opposite second end segment 337, and the second end segment 337 is in front of the first end segment 336 in the front-rear direction (Y). The rear movable handle plate 33 is formed by a piece of sheet metal bent to form a channel shape. Similar to the description of the front movable handle plate 32, the second guiding slot 333 of the rear movable handle plate 33 actually has two opposite left and right ends being formed respectively in the side walls 320 in this embodiment.

The linkage mechanism 4 is operatively disposed with respect to the fixed structure 2 and the movable structure 3, and includes a linkage bar 41 and a tension spring 42. The front end of the linkage bar 41 is pivotally coupled to the front movable handle plate 32 with a securing pin extending through the rod pivot hole 325 of the front movable handle plate 32 and the front end of the linkage bar 41. The linkage bar 41 has a rear end engaging a front end surface of the adjusting screw 23, and a stop edge 411 on the lower side for abutting against the rear movable handle plate 33. The tension spring 42 is connected between the movable jaw plate 31 and the fixed handle plate 22.

Figure 10:
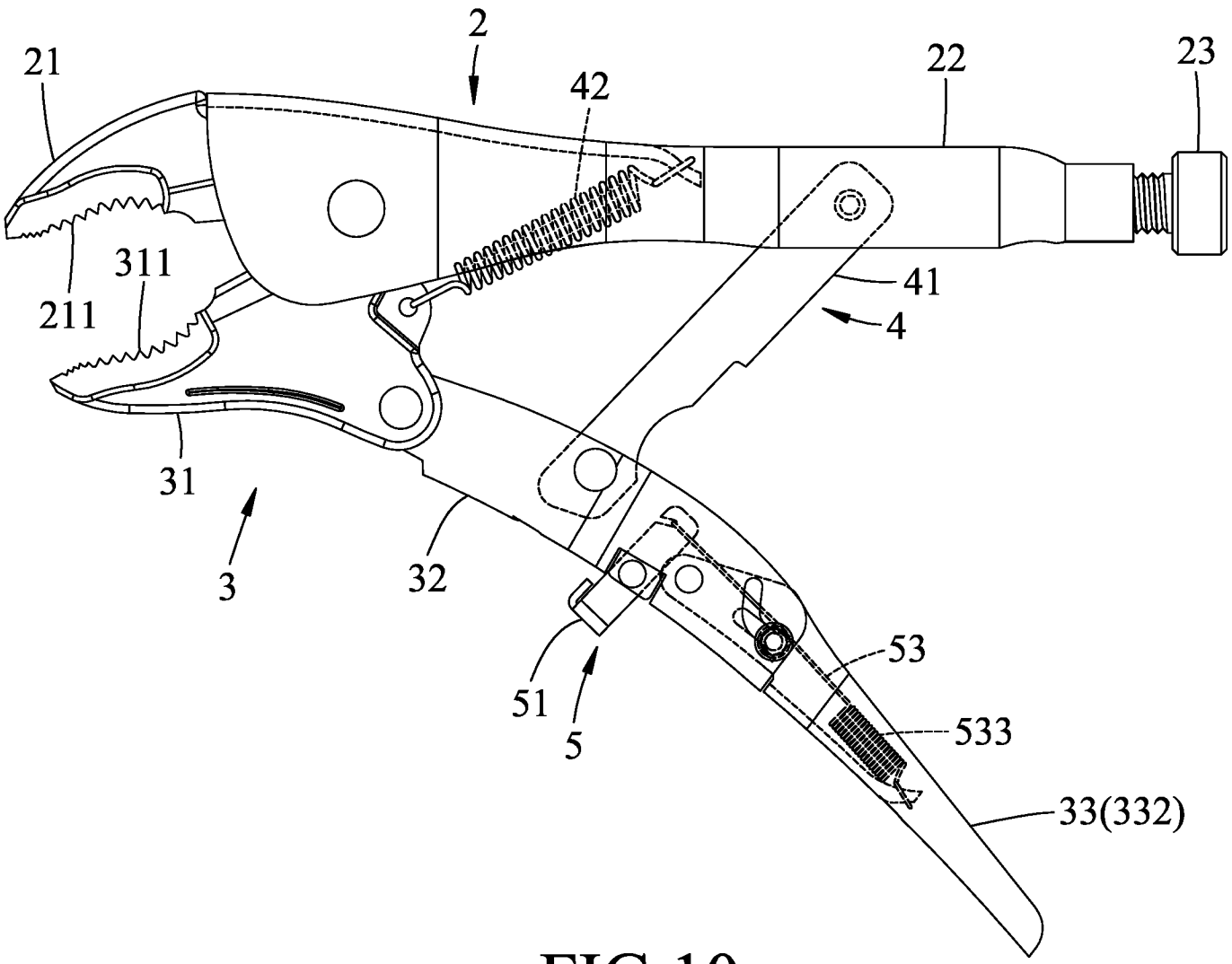
FIG. 10 is a view illustrating the movable structure shifted to a releasing position.

Referring to FIGS. 6 and 10, the linkage mechanism 4 is provided for controlling the shift of the movable structure 3 relative to the fixed structure 2 between a retaining position (see FIG. 6) and a releasing position (see FIG. 10). As shown in FIG. 6, when the movable structure 3 is in the retaining position, the grip end 332 of the rear movable handle plate 33 is relatively close to the fixed handle plate 22 of the fixed structure 2, and the movable clamping portion 311 is adjacent to the fixed clamping portion 211 to form the clamping hole 200 therebetween facilitating firmly gripping an object (not shown). At this position, the rear movable handle plate 33 abuts against the stop edge 411, the tension spring 42 connected between the movable jaw plate 31 and the fixed handle plate 22 is resiliently stretched. As shown in FIG. 10, when the movable structure 3 is shifted to the releasing position, the grip end 332 of the rear movable handle plate 33 is relatively spaced apart from the fixed handle plate 22 of the fixed structure 2, and the movable clamping portion 311 is pivoted to be far from the fixed clamping portion 211 under the restoring force of the tension spring 42, the gripped object thus can be released.

Referring to FIGS. 4 to 7, the quick release mechanism 5 is operatively disposed on the movable structure 3, and includes a trigger 51, a fixing pin 52 and a resilient locking subunit 53. The trigger 51 is pivotally coupled to and accessibly protrudes from the front movable handle plate 32. In this embodiment, the trigger 51 is formed by bending a piece of sheet metal and has two parallel side walls 510 spaced apart in the left-right direction (X). Each side wall 510 has a hook slot 511 at a top end thereof, a pulling end 512 located lower than the hook slot 511 in the top-bottom direction (Z), and a fixing pin hole 513 located between the hook slot 511 and the pulling end 512. Each of the hook slot 511 and the fixing pin hole 513 has two opposite left and right ends being formed respectively in the two side walls 510. The connecting pin 52 extends through the connecting hole 324 of the front movable handle plate 32 and the fixing pin hole 513 to pivotally connect the trigger 51 to the front movable handle plate 32 such that the trigger 51 can be rotated about the fixing pin 52. In other variations, the trigger 51 can also be a solid structure, and the hook slot 511 and the fixing pin hole 513 can be formed in similar way. The resilient locking subunit 53 includes an movable pin 531 inserted through and slidable along the first guide slot 321 and the second guide slot 333, a pulling member 532 fixedly connected between the movable pin 531 and the trigger 51, and a resilient member 533 connected between the movable pin 531 and the bar hook 334 of the rear movable handle plate 33. The pulling member 532 is of a U-shape consisting of two lateral sections and a front section which interconnects front ends of the two lateral sections. The pulling member 532 has opposite first and second ends 534, 535, which are respectively rear ends of the two lateral sections, connected respectively two ends of the movable pin 531. The front section of the pulling member 532 engages and is retained in the hook slot 511 of the trigger 51. In this embodiment, the resilient member 533 is a tension spring having a connecting end 537 mounted to the movable pin 531, and an opposite hook end 536 retained by the bar hook 334 of the rear movable handle plate 33, such that the resilient member 533 can be elongated or shortened as the movable pin 531 moves.

Figure 8:
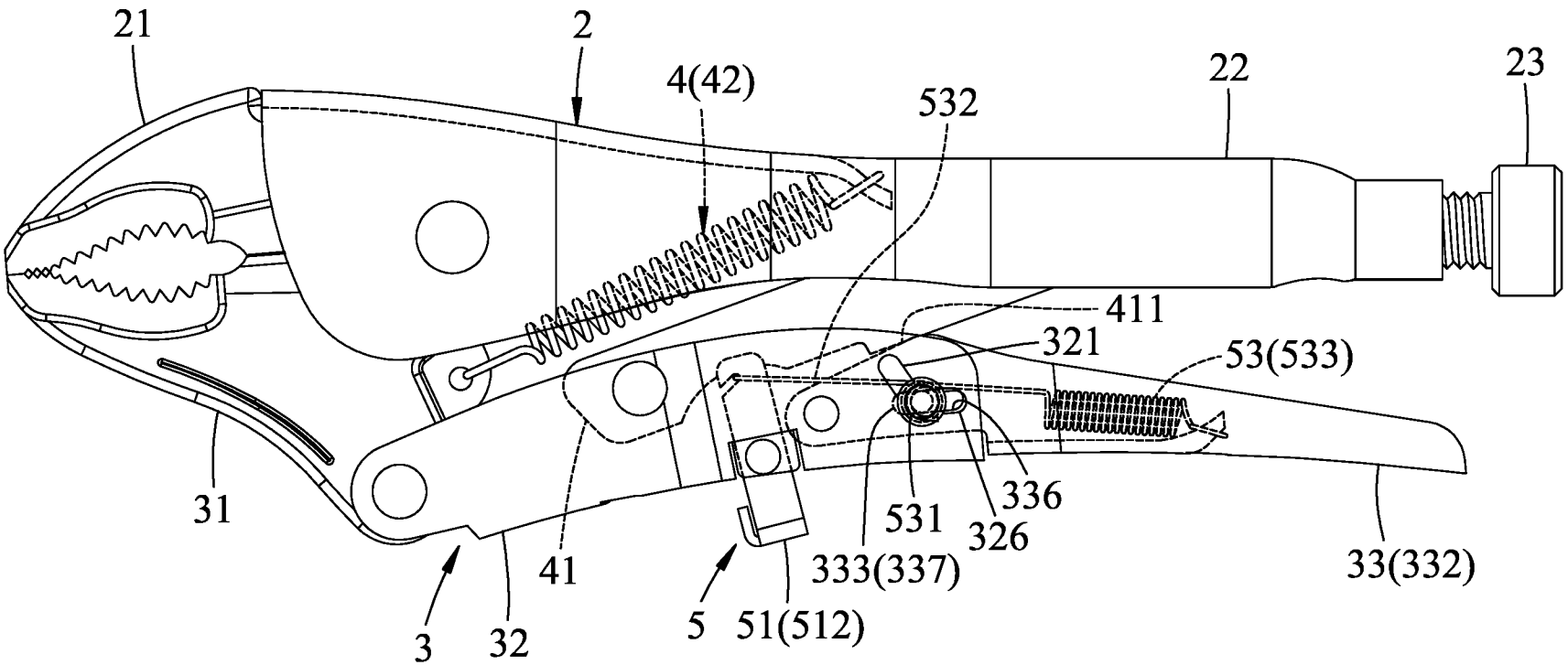
FIG. 8 is a view similar to FIG. 6, illustrating the resilient locking subunit in a non-locking state.

Referring to FIGS. 6 and 8, the trigger 51 can be used to switch the resilient locking subunit 53 from a locked state (see FIG. 6) to a non-locked state (see FIG. 8). As shown in FIG. 6, when the resilient locking subunit 53 is in the locked state, the locked segment 326 and the intermediate segment 328 of the first guide slot 321 are respectively registered with the first end segment 336 and the second end segment 337 of the second guide slot 333. At this time, the movable pin 531 is adjacent to the first end segment 336 of the second guide slot 333 and is located at the locked segment 326 of the first guide slot 321, and the movable pin 531 is restricted to move only in the front-rear direction (Y). Therefore, the rear movable handle plate 33 cannot pivot relative to the front movable plate 32, and an object can be firmly gripped by the pliers in this locked state. As shown in FIG. 8, when the resilient locking subunit 53 is switched to the non-locked state by pulling rearward on the trigger 51, the movable pin 531 is driven by the pulling member 532 to position adjacent to the second end segment 337 of the second guide slot 333 and to be located at the intermediate segment 328 of the first guide slot 321 (see FIG. 6), so that the movable pin 531 is released from the restriction and the rear movable handle plate 33 is permitted to pivot relative to the front movable handle plate 32. Meanwhile, the resilient member 533 is elongated to store a biasing force on the movable pin 531 toward the first end segment 336 of the second guide slot 333 and the locked segment 326 of the first guide slot 321.

Figure 9:
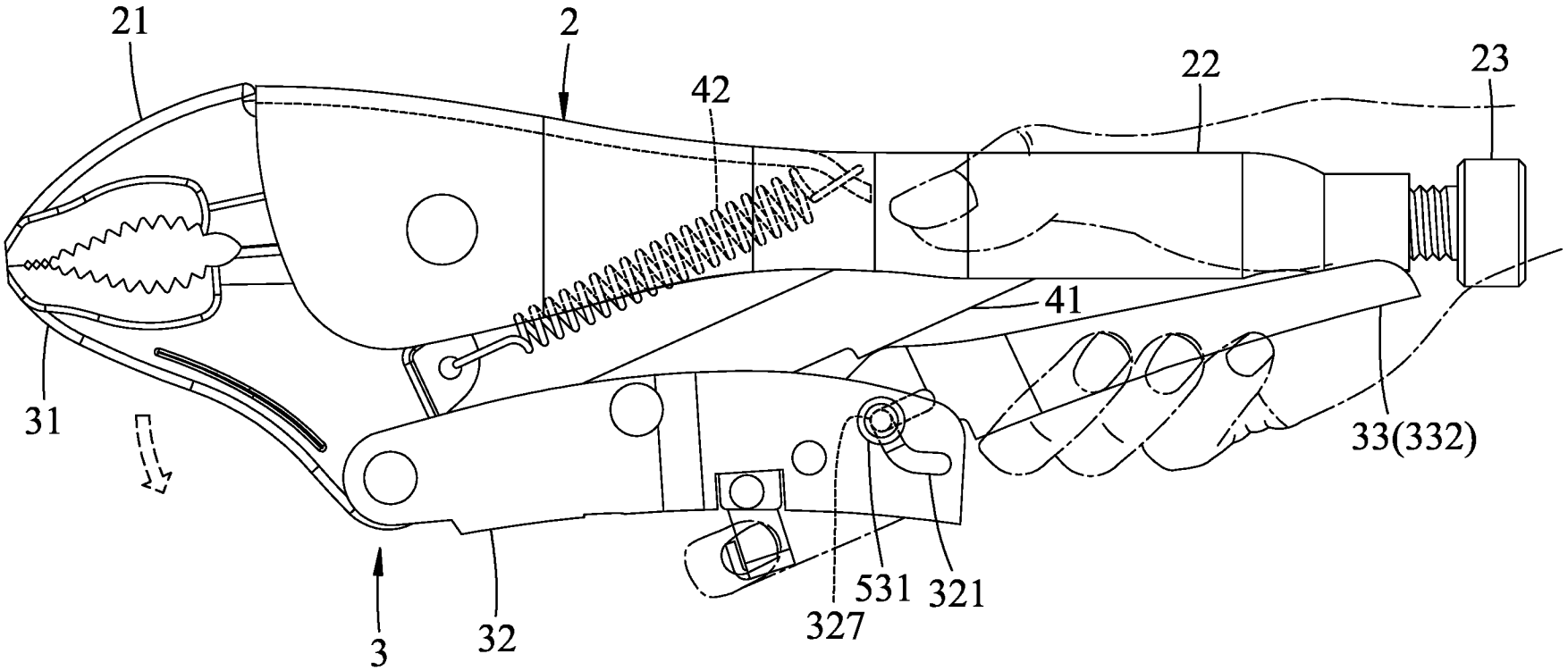
FIG. 9 is a view similar to FIG. 8, illustrating that a rear movable handle plate is pivoted relative to a front movable handle plate when the resilient locking subunit is in the non-locked state.

Referring to FIG. 6 and FIGS. 8 to 10, when it is needed to release the gripped object, a user can hold the fixed handle plate 22 and the rear movable handle plate 33 of the pliers with one hand and pull rearward on the trigger 51 with one finger of that hand to force the movable pin 531 into the intermediate segment 328. Then, as shown in FIG. 9, using other fingers of that hand to pull up the grip end 332 of the rear movable handle plate 33, the movable pin 531 thus is forced into the releasing segment 327 of the first guide slot 321, so that the rear movable handle plate 33 can be pivoted relative to the front movable handle plate 32 to drive the linkage bar 41 to pivot with the movable jaw plate 31 via the abutment of the rear movable handle plate 33 against the stop edge 411 of the linkage bar 41 to convert the movable structure 3 to the releasing position against the resilient force of the tension spring 42 which is configured to pull the movable jaw plate 31 open. Meanwhile, the resilient member 533 returns to its original configuration and brings the resilient locking subunit 53 to the locked state for the next use. As can be seen from the above, the user can manipulate the universal pliers of the present embodiment with one hand and keep another hand free.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth subunit that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pair of universal pliers comprising:

a fixed structure extending in a front-rear direction, and including a fixed jaw plate and a fixed handle plate that extends rearward from said fixed jaw plate, said fixed jaw plate having a fixed clamping portion;

a movable structure movably connected to said fixed structure, and including a movable jaw plate that has a movable clamping portion opposite to said fixed clamping portion and forming a clamping hole that is in conjunction with said fixed clamping portion, a front movable handle plate that is pivotally coupled to and extends rearward from said movable jaw plate, said front movable handle plate having a first guide slot at a rear end thereof, said first guide slot defining a locked segment and a releasing segment at opposite ends thereof, and an intermediate segment between said locked segment and said releasing segment, and a rear movable handle plate that has a pivoting end pivotally coupled to said front movable handle plate, a grip end opposite to and disposed at a rear side of said pivoting end, and a second guide slot located between said pivoting end and said grip end, said movable structure being movable relative to said fixed structure between a retaining position where said movable clamping portion is adjacent to said fixed clamping portion, and a releasing position where said movable clamping portion is spaced far from said fixed clamping portion; and a quick release mechanism including a trigger that is pivotally coupled to and accessibly protrudes from said front movable handle plate, and a resilient locking subunit that is operatively connected to said trigger and said movable structure, and that includes a movable pin inserted through and slidable along said first guide slot and said second guide slot, a pulling member connected between said movable pin and said trigger, such that the pivot action of said trigger drives said resilient locking subunit to switch between a locked state where said movable pin is located at said locked segment of said first guide slot and where said rear movable handle plate is not permitted to pivot relative to said front movable handle plate, and a non-locked state where said movable pin is located at said intermediate segment of said first guide slot and where said rear movable handle plate is permitted to pivot relative to said front movable handle, and a resilient member connected between said movable pin and said rear movable handle plate to resiliently bias said resilient locking subunit towards the locked state;

wherein said trigger has a hook slot for retaining said pulling member, a pulling end lower than said hook slot in a top-bottom direction, and a fixing pin hole between said hook slot and said pulling end, said quick release mechanism further including a fixing pin that extends through said front movable handle plate and said fixing pin hole to pivotally connect said trigger to said front movable handle plate; and wherein said pulling member of said resilient locking subunit has a first end and an opposite second end connected respectively to two ends of said movable pin, with a section of said pulling member between said first end and said second end being retained in said hook slot.

2. The universal pliers as claimed in claim 1, wherein said second guide slot has a first end segment and an opposite second end segment, said movable pin is adjacent to said first end segment when said resilient locking subunit is in said locked state, and said movable pin is adjacent to said second end segment when said resilient locking subunit is switched to said non-locked state.

3. The universal pliers as claimed in claim 1, wherein said resilient member has a connecting end mounted to said movable pin and an opposite hook end, said rear movable handle plate having a rear handle pivot hole and a bar hook respectively at said pivoting end and said grip end, said movable structure further including a pivot pin extending through said front movable handle plate and said rear handle pivot hole to pivotally connect said rear movable handle plate to said front movable handle plate, said bar hook engaging said hook end of said resilient member.

4. The universal pliers as claimed in claim 3, wherein said rear movable handle plate is pivotable relative to said front movable handle plate about said pivot pin when said resilient locking subunit is switched to said non-locked state.

5. The universal pliers as claimed in claim 1, further comprising a linkage mechanism which includes a linkage bar pivotally coupled to said front movable handle plate, and having a stop edge for abutting against said rear movable handle when said movable structure is in said retaining position, and a tension spring connected between said movable jaw plate and said fixed handle plate, said tension spring is resiliently stretched when said movable structure is in said retaining position, said rear movable handle plate being pivotable relative to said front movable handle plate to drive said linkage bar and said movable jaw plate to pivot when said resilient locking subunit is switched to said non-locked state to thereby move said movable structure to the releasing position under a restoring force of said tension spring.

6. The universal pliers as claimed in claim 1, wherein said front movable handle plate further has a connecting hole, said fixing pin extending through said connecting hole and said trigger to pivotally connecting said trigger to said front movable handle plate.

7. The universal pliers as claimed in claim 1, wherein said releasing segment of said first guide slot is in front of said locked segment in the front-rear direction and higher than said locked segment in a top-bottom direction.

* * * * *